US009612021B2

(12) United States Patent
Wood et al.

(10) Patent No.: US 9,612,021 B2
(45) Date of Patent: Apr. 4, 2017

(54) COMPRESSIVE STABILIZING GRATE FOOT FOR HOME APPLIANCE

(75) Inventors: Mark Wood, New Bern, NC (US); Anthony Zymroz, Jr., Trenton, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 603 days.

(21) Appl. No.: 12/822,251

(22) Filed: Jun. 24, 2010

(65) Prior Publication Data

US 2011/0315835 A1 Dec. 29, 2011

(51) Int. Cl.
*A47B 91/00* (2006.01)
*F16M 11/20* (2006.01)
*F24C 15/10* (2006.01)

(52) U.S. Cl.
CPC ..... *F24C 15/107* (2013.01)

(58) Field of Classification Search
CPC ..... A47B 91/00
USPC ..... 248/188.1, 188.8, 188.9, 677, 615; 126/215
See application file for complete search history.

(56) References Cited

U.S. PATENT DOCUMENTS 2,806,314 A * 9/1957 Moran ..... 248/687
3,076,221 A * 2/1963 Reynolds ..... 16/42 R
3,401,908 A * 9/1968 Rapata ..... 248/188.8
3,640,496 A * 2/1972 Duncan ..... 248/188.9
3,651,796 A * 3/1972 Nelson ..... 126/215
3,722,026 A * 3/1973 Wilhelmi ..... 16/42 T
4,718,631 A * 1/1988 Reynolds et al. ..... 248/615
5,007,607 A * 4/1991 Kim ..... 248/188.9
5,088,669 A * 2/1992 Zinnbauer ..... 248/188.9
5,115,797 A * 5/1992 Hurner ..... 126/214 R
5,153,052 A * 10/1992 Tanaka et al. ..... 428/212
5,169,115 A * 12/1992 Chung Hsiang ..... 248/677
5,372,121 A * 12/1994 Castillo et al. ..... 126/214 R
5,400,998 A * 3/1995 Ma ..... 248/615
5,775,316 A 7/1998 Jones
6,173,708 B1 * 1/2001 Arntz et al. ..... 126/39 R
6,470,879 B1 * 10/2002 Taplan ..... 126/215
6,719,256 B2 * 4/2004 Rydell et al. ..... 248/346.11
6,915,993 B2 * 7/2005 O'Leary ..... 248/188.9
6,978,778 B2 * 12/2005 Hawkins et al. ..... 126/215
2006/0201497 A1 9/2006 Lee
2009/0044795 A1 * 2/2009 Shaffer et al. ..... 126/215

* cited by examiner

*Primary Examiner* — Terrell McKinnon
*Assistant Examiner* — Michael McDuffie
(74) *Attorney, Agent, or Firm* — Michael E. Tschupp; Andre Pallapies

(57) ABSTRACT

A foot for a pan support of a home appliance is provided. The foot includes an insertion portion at a first end of the foot for inserting into a recess in the pan support; and a lower portion adjacent the insertion portion, the lower portion having a compression edge at a second end of the foot opposite the first end in a longitudinal direction of the foot. The compression edge is adapted to deform under the weight of the pan support when the foot is received by a flat receiving surface of the home appliance.

17 Claims, 3 Drawing Sheets

COMPRESSIVE STABILIZING GRATE FOOT FOR HOME APPLIANCE

FIELD OF THE INVENTION

The invention is directed to a foot for a grate or pan support, and, more particularly, to a compressive grate foot that stabilizes a grate or pan support.

An example of an application for the invention is a foot on a grate or pan support of a household gas cook top.

BACKGROUND OF THE INVENTION

Many home appliances, such as, for example, gas cook tops, have a grate or pan support that is positioned above a heat source, such as a gas burner. The grate often sits on a sheet metal upper surface, or mainsheet, of the cook top and is supported by a number of feet. Often four or six feet are used to support a single grate. Grates are usually made of a rigid, strong, material such as cast metal. Because the grates are rigid and are usually supported by more than three feet, the grates have a tendency to rock due to the grate or the mainsheet not being perfectly flat.

A rocking grate can be an unstable support for a pan being used on the cook top, which can result in spilled food items and/or an unlevel cooking surface. A grate that is not stable and tends to rock also gives an appearance of low quality to the cook top.

Also, grates made of metal, such as cast iron, can be very heavy. A heavy grate having metal or hard rubber feet can create a loud bang when dropped from only a small distance above a sheet metal mainsheet. This loud noise is undesirable and the impact of the metal or hard rubber feet can damage the mainsheet and/or grate.

SUMMARY

The invention recognizes that it is desirable to provide a stable foundation for a grate on a cook top. In addition, the invention realizes that it is desirable to provide grate feet that soften the impact between the grate and the mainsheet when the grate is dropped onto the mainsheet.

Exemplary embodiments of the invention provide a pliable grate foot that stabilizes the grate on the mainsheet.

Particular embodiments of the invention are directed to foot for a pan support of a home appliance, the foot including an insertion portion at a first end of the foot for inserting into a recess in the pan support; and a lower portion adjacent the insertion portion, the lower portion having a compression edge at a second end of the foot opposite the first end in a longitudinal direction of the foot. The compression edge is adapted to deform under the weight of the pan support when the foot is received by a flat receiving surface of the home appliance.

Other embodiments of the invention are directed to a grate for a home appliance, the grate including a pan support having a recess; and a foot. The foot has an insertion portion at a first end of the foot that is inserted into a recess in the pan support; and a lower portion adjacent the insertion portion, the lower portion having a compression edge at a second end of the foot opposite the first end in a longitudinal direction of the foot. The compression edge is adapted to deform under the weight of the pan support when the foot is received by a flat receiving surface of the home appliance.

Still other embodiments of the invention are directed to a home appliance, the home appliance including a mainsheet having a foot receiving surface, the foot receiving surface being flat; a pan support having a recess; and a foot. The foot has an insertion portion at a first end of the foot that is inserted into a recess in the pan support; and a lower portion adjacent the insertion portion, the lower portion having a compression edge at a second end of the foot opposite the first end in a longitudinal direction of the foot. The compression edge deforms under the weight of the pan support when the foot is received by the foot receiving surface of the mainsheet.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Figure 1:
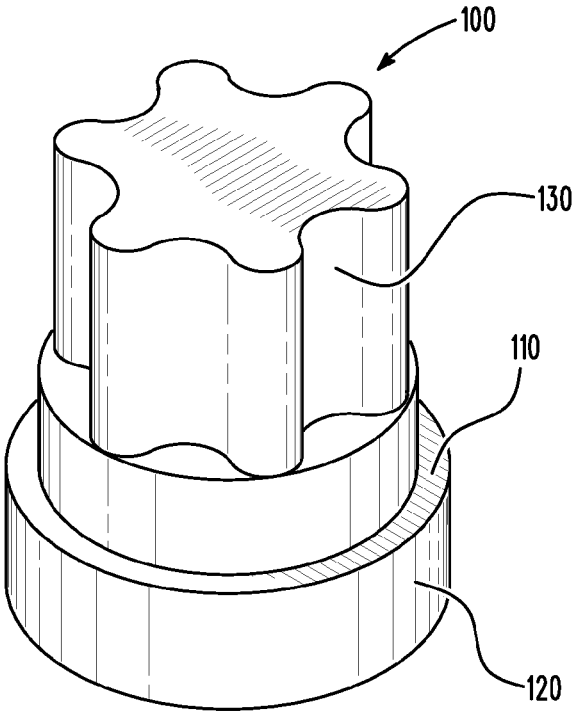
FIG. 1 is a perspective view of a grate foot that is an exemplary embodiment of the invention.
Figure 2:
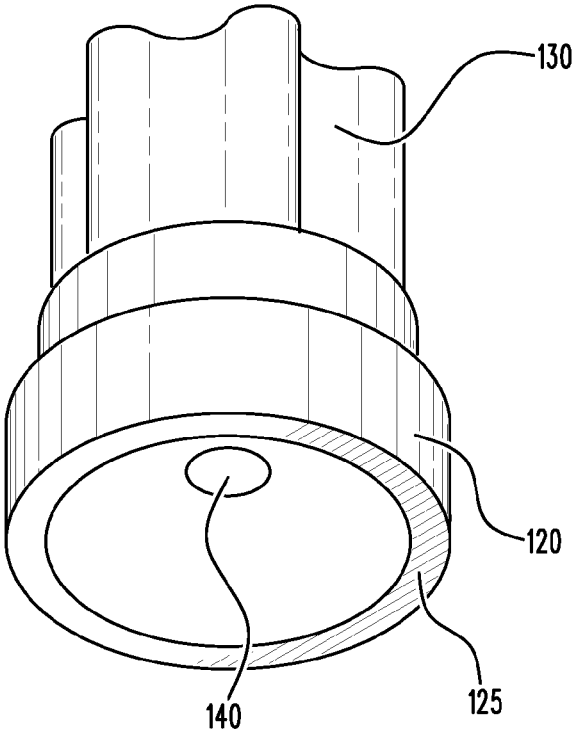
FIG. 2 is a perspective view of the exemplary embodiment shown in FIG. 1.

FIGS. 1 and 2 show an example of an embodiment of the invention. In this example, a foot 100 has a lower section 120 is separated from an upper section by a shoulder 110. The upper section has a shape that creates recesses 130 around a perimeter of the upper section. As shown in FIG. 2, lower section 120 has at its bottom end a compression edge 125 that forms a thin contact patch with a surface on which foot 100 rests.

Figure 3:
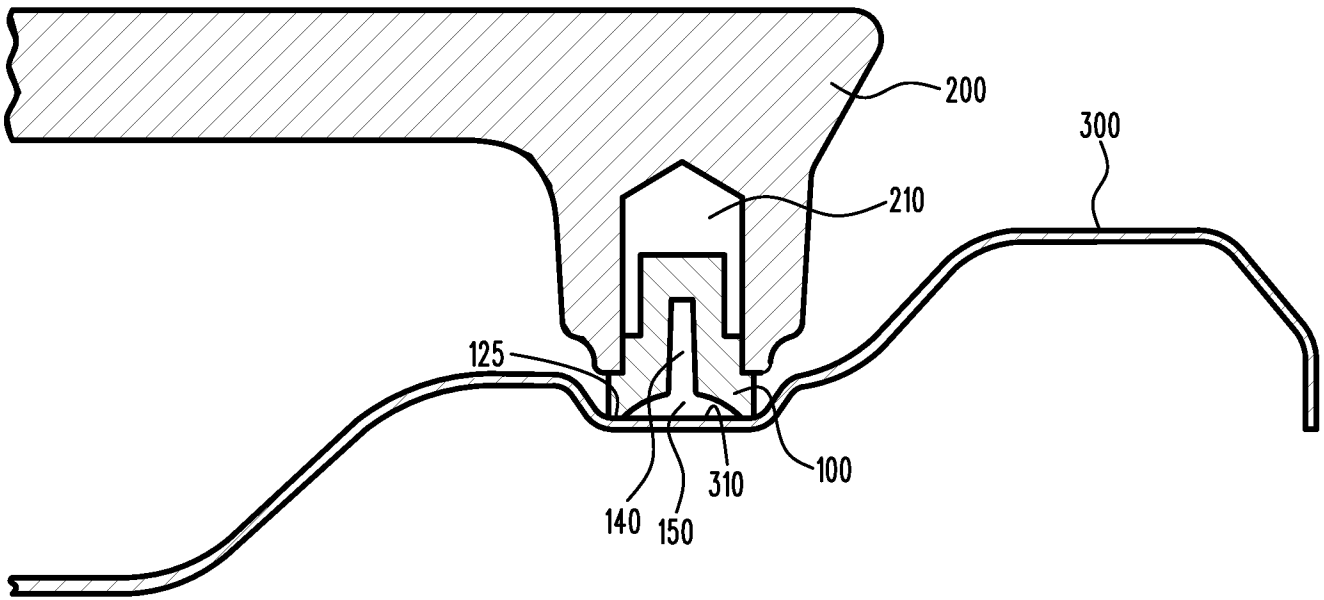
FIG. 3 is side sectional view of the exemplary embodiment shown in FIGS. 1 and 2.

FIG. 3 shows a cross-section of foot 100 installed in a recess 210 of a grate or pan support 200. In this example, foot 100 is inserted into recess 210 until shoulder 110 contacts a lower edge of pan support 200. Recesses 130 of foot 100 create spaces between foot 100 and recess 210 for an optional adhesive for bonding 100 to pan support 200. In some embodiments foot 100 is held in place in recess 210 by a friction fit, while in some embodiments an adhesive holds foot 100 and place.

In some embodiments a hole 140 is provided in foot 100. Hole 140 can serve multiple functions. Hole 140 can receive a pin that guides and stretches foot 100 during installation and recess 210. Hole 140 can also provide added air volume to increase a suction effect between foot 100 and the surface on which foot 100 rests.

In the example shown in FIG. 3, foot 100 rests on a flat portion 310 of a mainsheet 300 of a cooktop. Mainsheet 300 is, in this example, a piece of formed sheet metal that is the upper surface of the cooktop, through which gas burners extend. Pan support 200 rests on mainsheet 300 at a number (usually four or six) areas to support pans over the gas burners. Pan support 200 is usually made from a metal such as, for example, cast iron. During the manufacturing process, the mainsheet and/or the pan support can be slightly twisted or otherwise not perfectly straight or level. If no feet are applied to the pan support, or if non-compressible feet are used, these twisted or non-flat components can result in the pan support rocking when placed on the mainsheet. Such rocking is undesirable because it does not provide a stable support for pans and because it portrays poor quality.

Compression edge 125 at the lower end of foot 100 provides a deformable contact patch between foot 100 and mainsheet 300. Having a foot 100 at each contact point between pan support 200 and mainsheet 300 (or at least all but one of the contact points), provides deformable contact patches that can compensate for irregularities in pan support 200 and/or mainsheet 300. As a result, a pan support having one or more of its lower support surfaces (the bottom edges of recess 210 in FIG. 3) not coplanar will compress one or more of the feet in different amounts to provide a stable, fully supported platform for supporting pans. Similarly, if the areas of mainsheet 300 that receive the feet are not coplanar, one or more of the feet will compress in different amounts. While this example has referred to the contact points between the pan support and the mainsheet being ideally coplanar, it is noted that the invention can provide a conforming support system for any pan support/mainsheet combination that has irregularities in their contact patches.

Examples of compression edge 125 have a thickness in the horizontal direction of approximately 10% of the overall width of lower section 120 (resulting in approximately 20% of the overall width of lower section 120 being in contact with mainsheet 300). Other examples of compression edge 125 have a thickness of less than 10% of the overall width of lower section 120. Particular examples of compression edge 125 have a thickness of less than 5% of the overall width of lower section 120. While the embodiment in the figures provides compressibility by way of a thin compression edge 125, other embodiments provide compressibility by using a thicker compression edge and a more compressible material.

While the embodiment shown in the figures has a round lower section 120, it is noted that the lower section of foot 100 can have other shapes, such as, for example, square, rectangular, oval, or any other shape.

Some conventional systems provide a convex feature on the mainsheet and corresponding concave feature on the foot. The purpose of this configuration is to provide location of the pan support relative to the mainsheet in a horizontal plane. However, irregularities in the dimensions of the pan support, feet, and/or mainsheet can result in the pan support not resting properly on the mainsheet at all contact points. This can result in an unstable pan support. In particular embodiments of the invention, mainsheet 300 has a plurality of flat portions 310 for receiving feet 100. Because there is no feature (such as, for example, a convex portion) on mainsheet 300 that interacts with any feature (such as, for example, void 150) of foot 100, the invention allows for dimensional irregularities of the pan support and/or the mainsheet in the horizontal direction.

Void 150 in lower section 120, in conjunction with the compressibility of compression edge 125, can act as a suction cup on flat portion 310 of mainsheet 300. This suction cup effect can prevent pan support 200 from moving relative to mainsheet 300. The weight of pan support 200 and/or the weight of pans placed on pan support 200 (or a user pushing down on pan support 200) can push air from void 150. The subsequent lessening of weight on foot 100 can cause the pressure in void 150 to be less than atmospheric pressure, resulting in a suction cup effect between foot 100 and flat portion 310 of mainsheet 300.

Figure 4:
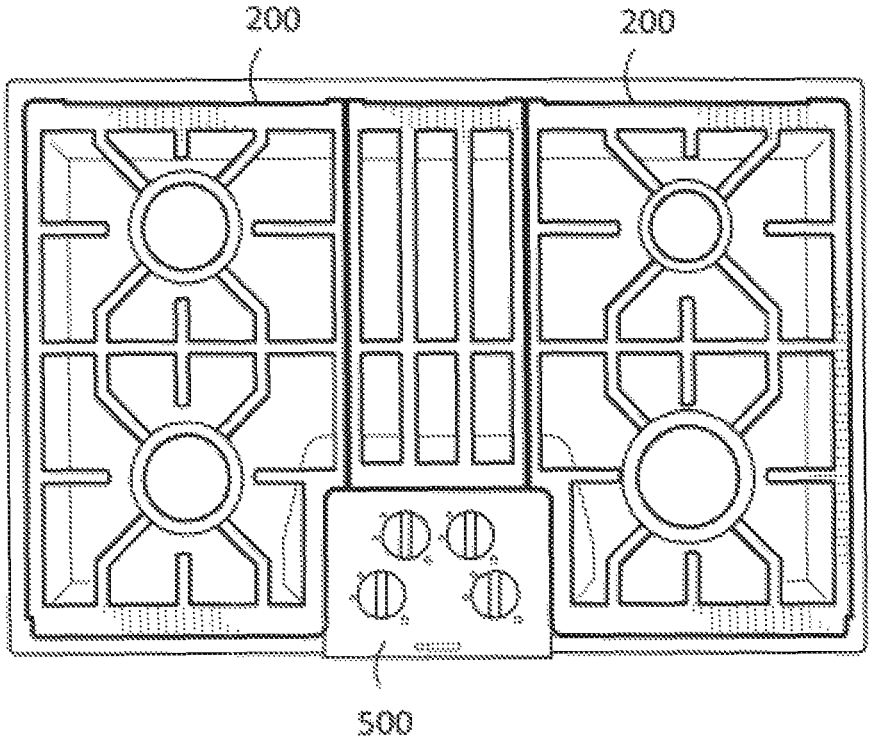
FIG. 4 shows a home appliance in accordance with the invention.

FIG 4 shows an example of a home appliance in accordance with the invention. The home appliance shown in FIG 4 is a cooktop 500 having a plurality og grates 200. Each grate 200 can have a plurality of the grate foot as shown, for example, in FIGS. 1-3, as described above. Other examples of home appliances in accordance with the invention include, for example, gas ranges.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A foot for a pan support of a home appliance, the foot comprising:

an insertion portion at a first end of the foot for inserting into a recess in the pan support; and a lower portion adjacent the insertion portion, the lower portion having a compression edge at a second end of the foot opposite the first end in a longitudinal direction of the foot, wherein the compression edge is adapted to deform under the weight of the pan support when the foot is received by a flat receiving surface of the home appliance, the compression edge is a resilient material;

a dome shaped recess is formed in the lower portion; and an elongated recess extending from the dome shaped recess into the insertion portion.

2. The foot of claim 1, wherein the home appliance is a cook top and the flat receiving surface is a mainsheet of the cook top.

3. The foot of claim 1, wherein the lower portion has a width in a transverse direction perpendicular to the longitudinal direction, the compression edge has a substantially uniform thickness along the transverse direction, and the thickness of the compression edge is at most 10% of the width of the lower portion.

4. The foot of claim 3, wherein the lower portion is circular, the width of the lower portion is the diameter of the lower portion, and the compression edge is located at the circumference of the lower portion.

5. The foot of claim 1, wherein the lower portion has a width in a transverse direction perpendicular to the longitudinal direction, the compression edge has a substantially uniform thickness along the transverse direction, the lower portion is circular, the width of the lower portion is the diameter of the lower portion, and the compression edge is located at the circumference of the lower portion.

6. The foot of claim 1, wherein the elongated recess in the foot is closed at its end farthest from the dome shaped recess.

7. A grate for a home appliance, the grate comprising:

a pan support having a recess; and a foot, the foot having an insertion portion at a first end of the foot that is inserted into a recess in the pan support;

a lower portion adjacent the insertion portion, the lower portion having a compression edge at a second end of the foot opposite the first end in a longitudinal direction of the foot, wherein the compression edge is adapted to deform under the weight of the pan support when the foot is received by a flat receiving surface of the home appliance, the compression edge is a resilient material;

a dome shaped recess is formed in the lower portion; and an elongated recess extending from the dome shaped recess into the insertion portion.

8. The grate of claim 7, wherein the home appliance is a cook top and the flat receiving surface is a mainsheet of the cook top.

9. The grate of claim 7, wherein the lower portion has a width in a transverse direction perpendicular to the longitudinal direction, the compression edge has a substantially uniform thickness along the transverse direction, and the thickness of the compression edge is at most 10% of the width of the lower portion.

10. The grate of claim 9, wherein the lower portion is circular, the width of the lower portion is the diameter of the lower portion, and the compression edge is located at the circumference of the lower portion.

11. The grate of claim 7, wherein the lower portion has a width in a transverse direction perpendicular to the longitudinal direction, the compression edge has a substantially uniform thickness along the transverse direction, the lower portion is circular, the width of the lower portion is the diameter of the lower portion, and the compression edge is located at the circumference of the lower portion.

12. The grate of claim 7, wherein the elongated recess in the foot is closed at its end farthest from the dome shaped recess.

13. A home appliance, comprising:

a mainsheet having a foot receiving surface, the foot receiving surface being flat;

a pan support having a recess; and a foot, the foot having an insertion portion at a first end of the foot that is inserted into a recess in the pan support; and a lower portion adjacent the insertion portion, the lower portion having a compression edge at a second end of the foot opposite the first end in a longitudinal direction of the foot, wherein the compression edge deforms under the weight of the pan support when the foot is received by the foot receiving surface of the mainsheet, the compression edge is a resilient material, a dome shaped recess is formed in the lower portion, and an elongated recess extending from the dome shaped recess into the insertion portion.

14. The home appliance of claim 13, wherein the lower portion has a width in a transverse direction perpendicular to the longitudinal direction, the compression edge has a substantially uniform thickness along the transverse direction, and the thickness of the compression edge is at most 10% of the width of the lower portion.

15. The home appliance of claim 13, wherein the lower portion has a width in a transverse direction perpendicular to the longitudinal direction, the compression edge has a substantially uniform thickness along the transverse direction, the lower portion is circular, the width of the lower portion is the diameter of the lower portion, and the compression edge is located at the circumference of the lower portion.

16. The home appliance of claim 13, wherein the dome shaped recess acts as a suction cup with the foot receiving surface of the mainsheet.

17. The home appliance of claim 13, wherein the elongated recess in the foot is closed at its end farthest from the dome shaped recess.

* * * * *